US007316577B2

(12) United States Patent
Latvaitis et al.

(10) Patent No.: US 7,316,577 B2
(45) Date of Patent: Jan. 8, 2008

(54) NICKEL FOAM PIN CONNECTIONS FOR INERT ANODES

(75) Inventors: J. Dean Latvaitis, Maryville, TN (US); Ronald M. Dunlap, Brackenridge, PA (US); Kenneth Butcher, Hendersonville, NC (US)

(73) Assignee: Alcoa, Inc., Pittsburgh, PA (US)

( * ) Notice: Subject to any disclaimer, the term of this patent is extended or adjusted under 35 U.S.C. 154(b) by 490 days.

(21) Appl. No.: 11/082,619

(22) Filed: Mar. 17, 2005

(65) Prior Publication Data

US 2005/0164871 A1 Jul. 28, 2005

Related U.S. Application Data

(62) Division of application No. 10/405,508, filed on Apr. 2, 2003, now Pat. No. 6,878,246.

(51) Int. Cl.
*H01R 4/58* (2006.01)

(52) U.S. Cl. ..... 439/86; 204/280

(58) Field of Classification Search ..... 204/279, 204/280, 286.1, 288.1, 288.2; 439/86, 179, 439/874, 930

See application file for complete search history.

(56) References Cited

U.S. PATENT DOCUMENTS

| | | | |
|---|---|---|---|
| 3,718,550 | A | 2/1973 | Klein |
| 4,374,761 | A | 2/1983 | Ray |
| 4,626,333 | A | 12/1986 | Secrist et al. |
| 4,999,023 | A | 3/1991 | Froloff |
| 5,112,236 | A | 5/1992 | Martin et al. |
| 5,279,715 | A | 1/1994 | La Camera et al. |
| 5,456,833 | A | 10/1995 | Butcher et al. |
| 5,567,544 | A | 10/1996 | Lyman |
| 5,673,902 | A | 10/1997 | Aubrey et al. |
| 6,051,117 | A | 4/2000 | Novak et al. |
| 6,126,799 | A | 10/2000 | Ray et al. |
| 6,264,810 | B1 | 7/2001 | Stol et al. |
| 2001/0035344 | A1 | 11/2001 | D'Astolfo, Jr. et al. |

FOREIGN PATENT DOCUMENTS

| | | |
|---|---|---|
| JP | 11256398 | 9/1999 |

OTHER PUBLICATIONS

Butcher, Kenneth, Haack, David & Floyd, Donald, "Compact Heat Exchangers Incorporating Reticulated Metal Foam", 2001 Grove Symposium.

Haack, David, Butcher, Kenneth, Kim, T., Lu, T.J., "Novel Lightweight Metal Foam Heat Exchangers", 2001 ASME International Mechanical Engineering Congress and Exposition, Nov. 11-16, 2001, NY, NY, pp. 141-147.

*Primary Examiner*—Khiem Nguyen
(74) *Attorney, Agent, or Firm*—Greenberg Traurig, LLP

(57) ABSTRACT

An electrode assembly useful in manufacturing aluminum, contains a hollow inert electrode (12) containing a metal conductor (14) surrounded and held in place by at least one seal (16) and a mass of metal foam (26).

6 Claims, 5 Drawing Sheets

NICKEL FOAM PIN CONNECTIONS FOR INERT ANODES

CROSS REFERENCE TO RELATED APPLICATIONS

This application is a Divisional of application Ser. No. 10/405,508, filed on Apr. 2, 2003 now U.S. Pat. No. 6,878,246.

FIELD OF THE INVENTION

This invention relates to low resistance electrical connections between a solid metallic pin conductor and the interior of a ceramic or cermet inert anode used in the production of metal, such as aluminum, by an electrolytic process.

BACKGROUND OF THE INVENTION

A number of metals including aluminum, lead, magnesium, zinc, zirconium, titanium, and silicon can be produced by electrolytic processes. Each of these electrolytic processes employs an electrode in a highly corrosive environment.

One example of an electrolytic process for metal production is the well-known Hall-Heroult process producing aluminum in which alumina dissolved in a molten fluoride bath is electrolyzed at temperatures of about 960° C.-1000° C. As generally practiced today, the process relies upon carbon as an anode to reduce alumina to molten aluminum. The carbon electrode is oxidized to form primarily $CO_2$, which is given off as a gas. Despite the common usage of carbon as an electrode material in practicing the process, there are a number of disadvantages to its use, and so, attempts are being made to replace them with inert (not containing carbon) anode electrodes made of for example a ceramic or metal-ceramic "cermet" material.

Ceramic and cermet electrodes are inert, non-consumable and dimensionally stable under cell operating conditions. Replacement of carbon anodes with inert anodes allows a highly productive cell design to be utilized, thereby reducing costs. Significant environmental benefits are achievable because inert electrodes produce essentially no $CO_2$ or fluorocarbon or hydrocarbon emissions. Some examples of inert anode compositions are found in U.S. Pat. Nos. 4,374,761; 5,279,715; and 6,126,799, all assigned to Alcoa Inc.

Although ceramic and cermet electrodes are capable of producing aluminum having an acceptably low impurity content, they are susceptible to cracking during cell start-up when subjected to temperature differentials on the order of about 900° C.-1000° C. In addition, ceramic components of the anode support structure assembly are also subject to damage from thermal shock during cell start-up and from corrosion during cell operation. One example of an inert anode assembly for an aluminum smelting cell is shown in FIG. 3 of U.S. Patent Application Publication 2001/0035344 A1 (D'Astolfo Jr. et al.) where cup shaped anodes can be filled with a protective material to reduce corrosion at the interface between the connector pins and the inside of the anode. The anodes are then attached to an insulating lid or plate.

Making a low resistance electrical connection between a ceramic or ceramic-metallic electrode and a metallic conductor has always been a challenge. The connection must be maintained with good integrity (low electrical resistance) over a wide range of temperatures and operating conditions. Various attempts have been made with brazing, diffusion bonding, and mechanically connecting with limited success. Examples of sinter threading and electromechanical attachment are shown, for example, in U.S. Pat. Nos. 4,626,333 and 6,264,810 B1 (Secrist et al, and Stol et al. respectively). Also, differential thermal growth between the pin and ceramic or cermet, over the assembly and process temperature range can cause the inert material to crack and/or the electrical connection to increase in resistance; rendering the assembly unfit for continued use.

What is needed is a pin-to inert material interior connection that is simple, not labor intensive to assemble and which will provide a low electrical resistance connection that will not deteriorate over time or cause cracking of the anode. It is a main object of this invention to provide a low electrical resistance connection of the pin conductor and inert anode electrode. It is another object to reduce assembly costs and provide a simplified design and method.

SUMMARY OF THE INVENTION

The above needs are met and objects accomplished by providing, an electrode assembly comprising: a hollow inert electrode, containing a metal conductor having a bottom surface substantially surrounded within the hollow inert electrode by a material comprising or consisting essentially of metal foam. The metal foam is preferably nickel foam or nickel alloy foam. The term "metal foam" as used herein means elemental metal, such as all nickel, alloys of at least two metals, and metal coatings on metal, such as a nickel coating on copper foam, and the like. The invention also resides in an electrode assembly comprising: an inert electrode having a hollow interior with a top portion and interior bottom and side walls; a metal pin conductor having bottom and side surfaces, disposed within the electrode interior but not contacting the electrode interior walls; and a seal surrounding the metal pin conductor at the top portion of the electrode, providing a gap around the metal pin conductor bottom surface between the metal pin conductor and the electrode interior bottom and side walls, where a metal foam having a density of from 5% to 40% of the solid parent metal (relative density) fills the bottom portion of the gap. The metal foam is preferably nickel, nickel alloy or copper alloy foam, but coated copper foam, copper nickel foam or a variety of other metallic foams can be used that conform to the appropriate conductivity open cell network and compliancy. The metal foam, such as nickel alloy foam may contain or be coated with, other metals, such as: copper, nickel, silver, palladium or iridium. The metal foam preferably has a conductivity of from about 1,000 s/cm to about 26,000 s/cm (Siemens per centimeter). For sake of convenience, the foam will hereinafter primarily be referred to as "nickel foam", but this is in no way to be considered limiting. Also, the term "alloy" will mean any wt. % range of at least two metals in a metal body.

The inert electrode is preferably a ceramic, cermet, or metal-containing inert anode, the metal pin conductor is nickel or a corrosion protected steel alloy, preferably having a circular cross-section, the nickel foam can have different densities between the pin and interior electrode walls and the pin and interior electrode bottom, and preferably the nickel foam fills 100% of the resulting annular gap at the bottom, lower portion of the anode. The anode assembly is useful for an electrolytic cell.

The invention also resides in a method of producing an electrode assembly comprising: (1) providing an inert electrode having a hollow interior with a top portion and interior bottom and side walls; (2) inserting a metal pin conductor having bottom and side surfaces and a metal foam into the hollow interior of the electrode; and (3) sealing the top portion of the electrode.

The preferred nickel foam can be inserted and then the pin can be inserted at ambient temperatures and the assembly then sintered and sealed; or the nickel foam can be inserted at ambient temperatures, the electrode and foam then sintered and the pin then inserted via threads or the like and the assembly sealed; or the nickel foam and pin can be inserted with a tight interference fit into a previously sintered electrode and sealed at ambient temperatures.

The preferred nickel foam connection design alleviates cracked anodes due to differential thermal growth, provides a stable electrical joint resistance which does not degrade with age, and requires only foam between the pin and ceramic or cermet. This allows reduced materials and assembly costs and supports simplified automated assembly.

BRIEF DESCRIPTION OF THE DRAWINGS

A full understanding of the invention can be gained from the above and following description when read in conjunction with the accompanying drawings in which.

DETAILED DESCRIPTION OF PREFERRED EMBODIMENTS

Figure 1:
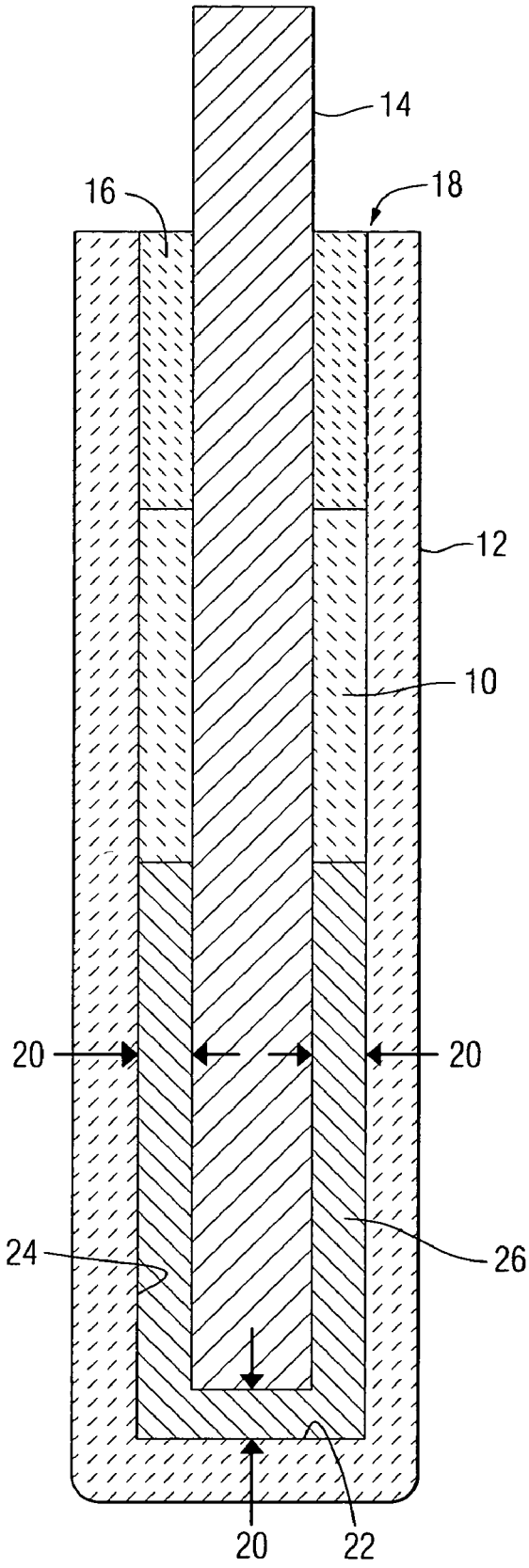
FIG. 1 is a cross-sectional view of one embodiment of an inert anode assembly showing the compliant metal foam filler around the conductor.
Figure 2:
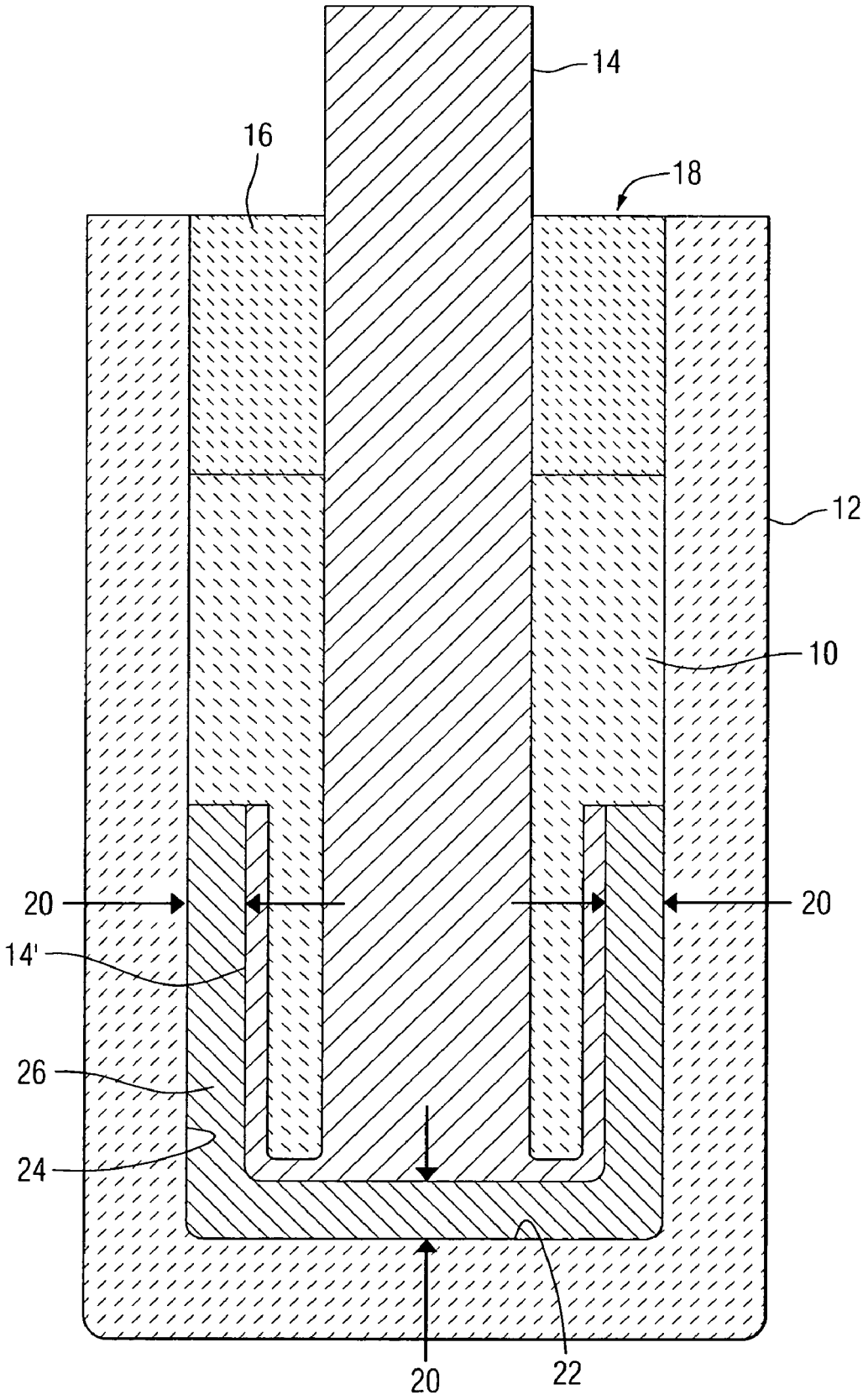
FIG. 2 is a cross-sectional view of another embodiment of an inert anode assembly for larger diameter electrodes, showing the compliant metal foam filler around a cup shaped enlarged bottom conductor.

For convenience, this invention will be described with reference to an electrode assembly for producing aluminum by an electrolytic process. Referring now to FIG. 1, one embodiment of an electrode assembly is shown. Not shown is the insulating lid to which the electrode assembly is attached. The inert electrode 12 is generally hollow, and made from a material selected from ceramic, cermet, metal, and mixtures thereof, preferably a hollow inert ceramic anode is shown with a metal conductor 14 shown partly disposed within the hollow electrode 12 and sealed with one or more seals 16 at the top 18 of the hollow electrode. The conductor 14 can be smooth as shown, be smaller or larger at the bottom, or have a wide variety of other geometrics, such as for example, the cup shape described below and in FIG. 2. Thus FIG. 1, with regard to the bottom of metal conductor 14, is not to be considered limiting in any fashion. That is, the bottom of metal conductor 14 can be of varying geometries and discontinuous diameters. FIG. 2 shows another embodiment of the electrode 14 having an extended base surface 14' at the base and sides at the bottom. The metal conductor may or may not have the enlarged base 14' shown in FIG. 2. The enlarged base 14' reduces the volume of the annular gap to be filled with nickel foam for larger diameter electrodes.

As used herein, the term "inert anode" refers to a substantially non-consumable, non-carbon anode having satisfactory resistance to corrosion and dimensional stability during the metal production process. This can be a ceramic, cermet (ceramic/metal), or metal-containing material.

Figure 3:
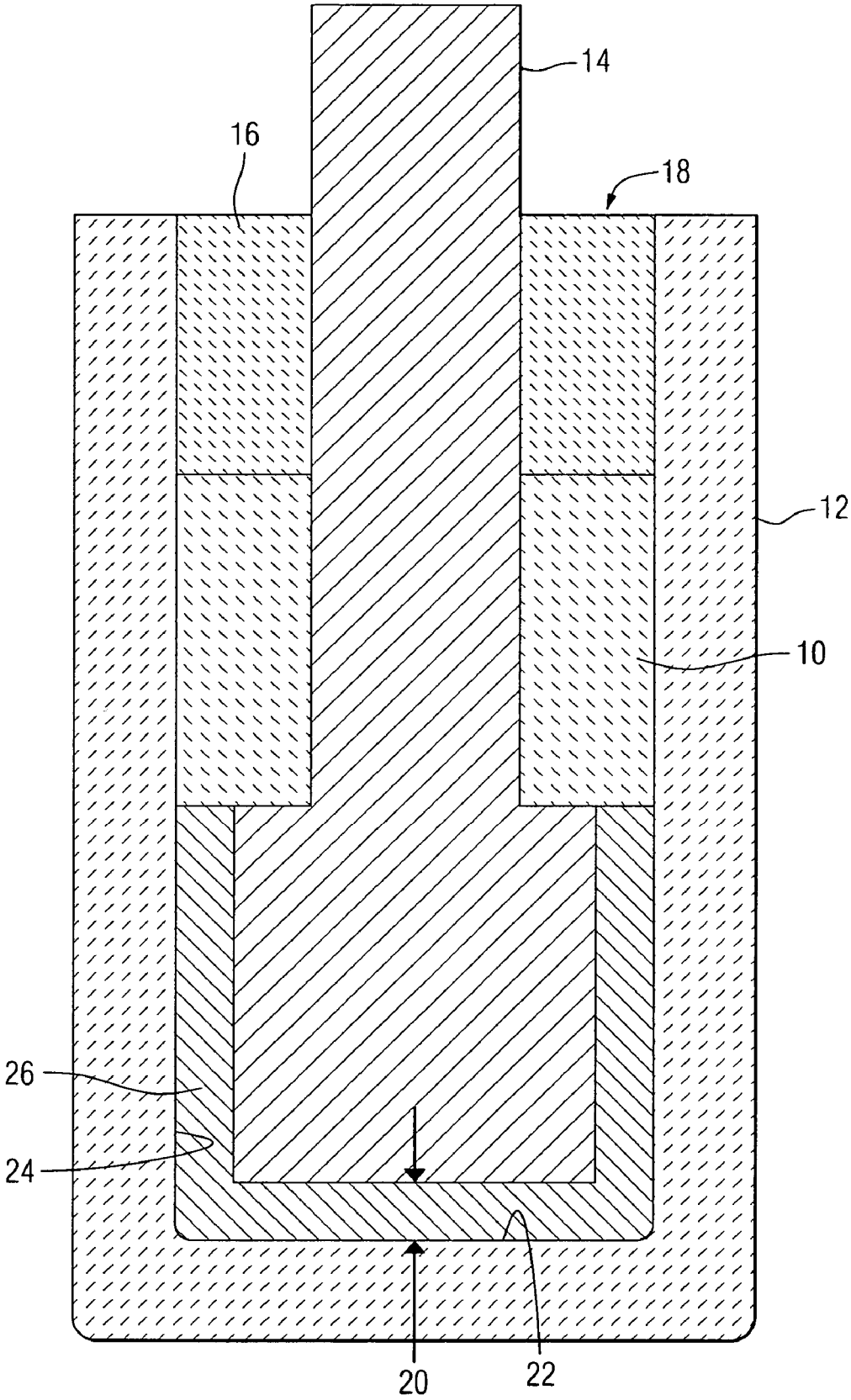
FIG. 3 is a cross-sectional view of another embodiment of an inert anode, showing the compliant metal frame filler around an enlarged bottom conductor, which bottom can be solid or hollow.

Referring back to FIG. 1, the metal conductor 14 is usually of a pin/rod design and can have a circular cross-section as shown in FIG. 1. The conductor rod 14 is made smaller than the hole in the hollow electrode. The gap 20 (as shown between the arrows) is filled with a conductive material, in this invention preferably metal foam 26 such as nickel foam, nickel alloy foam, copper alloy foam, and the like, as previously described and as will be described later. Corrosion resistant steel alloy is the preferred material for the rod due to its conductivity and relatively low cost, but Ni can be used because of its enhanced corrosion resistance. The steel alloy can have a surface coating or covering of nickel, inconel, zirconium, ceramic, cermet, or other materials to make it corrosion resistant. One or more castable ceramic seals 16 for example, cast ceramic as well as additional insulation 10 support are usually used to surround, insulate, seal and attach the metal pin conductor at the top portion 18 and at the middle of the hollow, cup type, inert anode 12. The anode 12 would have a bottom interior wall 22 and side interior walls 24. The castable material 16 also mechanically supports the pin 14 in the electrode 12 at the top of the electrode. FIGS. 2 and 3 show a larger electrode design, when the conductor rod 14 has itself a cup like bottom 14' with an annular gap 20 here within the conductor itself, which gap within the electrode itself is filled with seal material 10 as shown and surrounded by metal foam 26 as shown in FIG. 2. The conductor rod 14 can have an enlarged tapered or square bottom, the latter as shown in FIG. 3, that is, thicker than the top of the conductor, which bottom of the conductor, while shown as solid can also be hollow to save weight and material.

The annular gap around the lower portion of metal pin conductor 14 and the bottom 22 of the electrodes 12 must be filled with a compliant, buffer material. It must be compliant enough to accommodate differential thermal growth between the ceramic or cermet electrode and the metal pin without causing stress cracks in the ceramic or cermet, while still maintaining acceptable electrical conductivity between both. These requirements have always created a materials problem.

We have found that metal foam, such as nickel foam 26 provides an outstanding and uniquely compliant material as the buffer in gap 20. Such a material is commercially available primarily as a catalyst substrate heat exchange material, but also as a sound and energy absorber, flame arrester or liquid filtration substrate, and is described at the web-site www.porvairfuelcells.com, "Metpore®". Metal foam heat exchanger elements have been described in *Grove Symposium Poster* 2001, "Compact Heat Exchangers Incorporating Reticulated Metal Foam" by K. Butcher et al. Sep. 11-13, 2001, and "Novel Lightweight metal Foam heat Exchangers" by D. P. Haack, K. R. Butcher and T. Kim Lu. 2001 *ASME Congress Proceedings*, New York, November 2001. Ceramic foam is described in U.S. Pat. Nos. 5,456,833 and 5,673,902. In general, a metallic foam can be made by impregnating an open cell flexible organic foam material, such as polyurethane, with an aqueous metallic slurry—containing fine metallic particles such as nickel particles.

Figure 4:
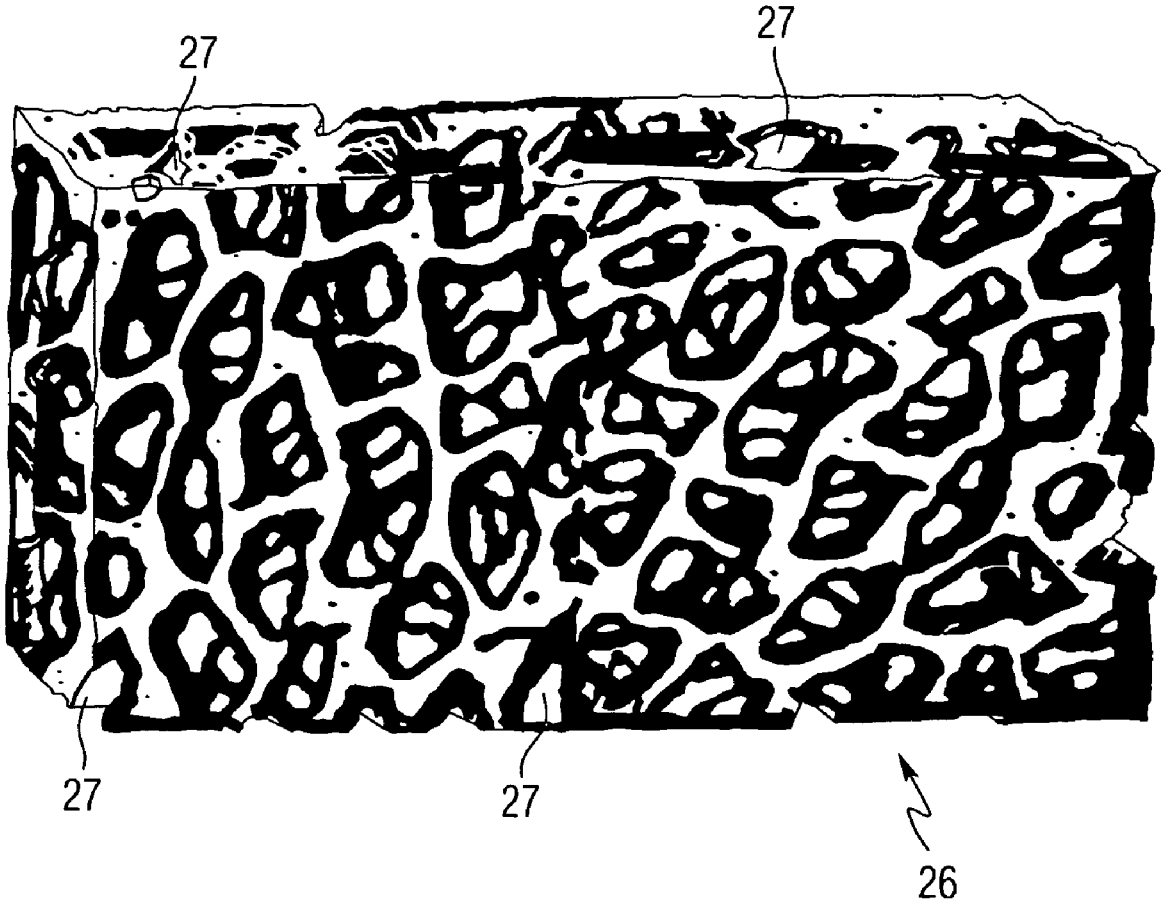
FIG. 4 is a magnified, idealized drawing of the general structure of one type of metal foam used in the anode assembly.

The impregnated organic foam is compressed to expel excess slurry. The material is then dried and fired to burn out the organic materials and to sinter the metal/ceramic coating. A rigid foam is thereby formed having a plurality of interconnecting voids having substantially the same structural configurations as the organic foam which was the starting material. The structure is generally seen in FIG. 4 where an idealized cross section of one type of such foam 26 is shown with its interconnecting voids and tortuous pathways 27. It has low density, between 5% and 40% of the solid parent metal, and high strength, and has been found compliant as a buffer within the inert anode structure. The term "compliant" or "compliancy" is here meant as having a modulus of elasticity which accommodates interference fit during assembly and differential thermal expansion between the pin conductor and inert anode, without transferring forces which result in damage to the inert anode. It has a reticulated, three dimensional, network structure with high surface area to density and a high melting temperature over 1000° C. (in pure form, usually between about 1435° C. to about 1455° C.), so that upon sintering or operation of the inert anode in an electrolytic process of making aluminum operating at up to about 1000° C., such as taught, for example, by LaCamera et al. in U.S. Pat. No. 527,715, the nickel foam can compress to provide a good fit between the metal pin outer surface and interior electrode wall surface without drawing away from those surfaces, or melting. Such a structure made of nickel would also have an acceptable electrical resistivity. This nickel foam is preferably used alone in the gap.

Figure 5:
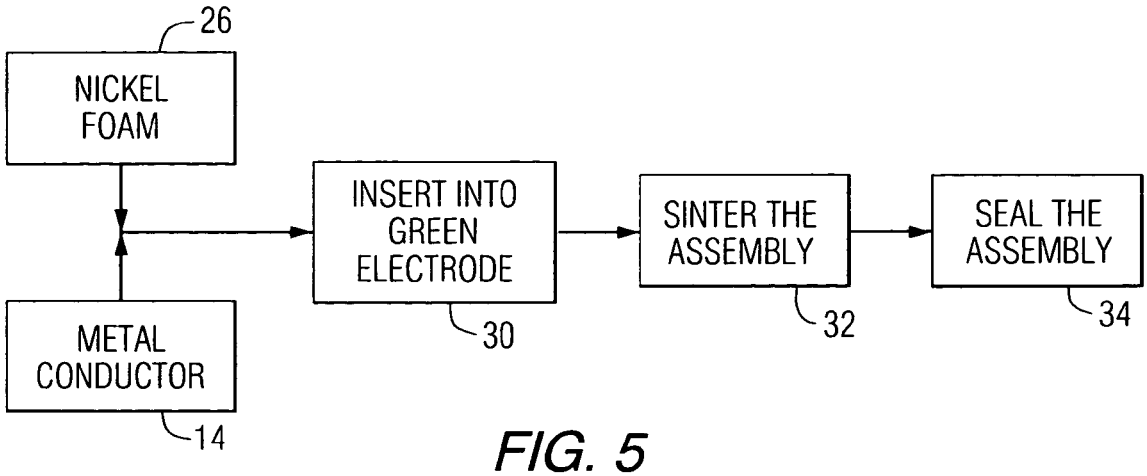
FIG. 5 is a block diagram of one method of producing the inert anode assemblies of this invention.
Figure 6:
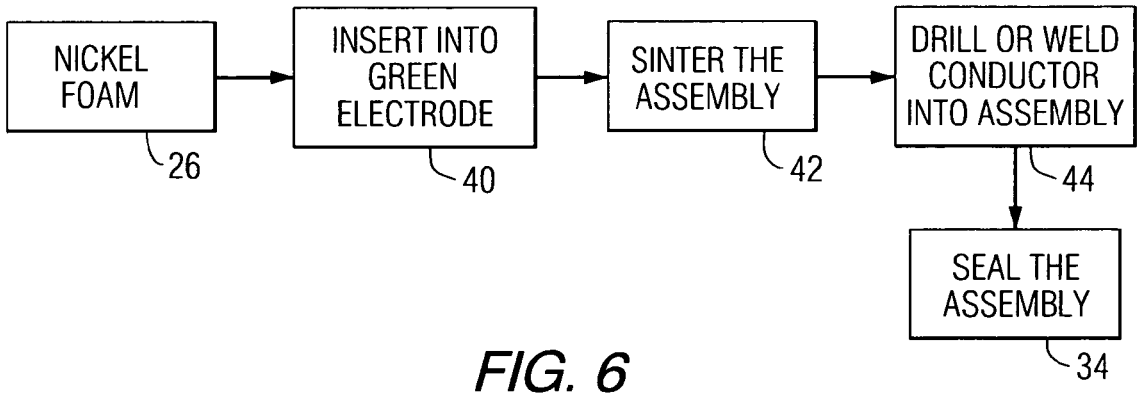
FIG. 6 is a block diagram of a second method of producing the inert anode assemblies of this invention.
Figure 7:
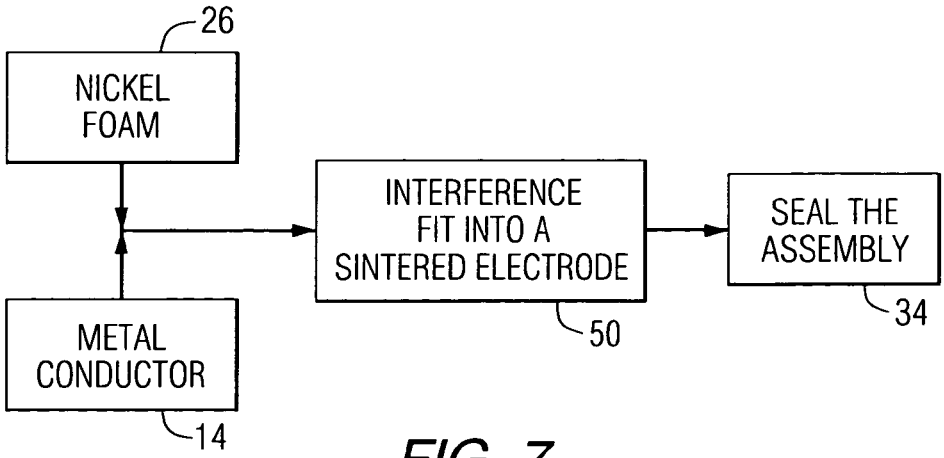
FIG. 7 is a block diagram of a third method of producing the inert anode assemblies of this invention.

Assembly of the anode assemblies of this invention, shown in FIGS. 5 to 7, may be accomplished in various ways including, FIG. 5: the metal pin 14, nickel foam buffer 26, and green (unsintered) anode 30 are assembled with a light contact fit at ambient temperature (about 25° C.). The assembly is then sinter heated 32 through the ceramic or cermet thermal cycle. During sintering, the ceramic or cermet shrinks compressing the foam, and securing/capturing the pin. The assembly is then sealed 34. No stress cracks result, electrical conductivity improves as the foam densifies and interface pressures increase. When the assembly is subsequently cooled, then later elevated to the 1000° C. process temperature, differential expansion further recompresses the foam and improves the conductivity; without cracking the cermet. If ceramic or cermet sintering temperatures are too high to allow pre-assembly with the pin; then, FIG. 6: only the nickel foam 26 insert is inserted 40 into a green electrode and sintered 42 into the ceramic or cermet. After cooling to ambient temperature the metal pin is connected to the foam via threads or welding, step 44 and subsequently sealed in step 34. By the term "green anode" is meant a previously pressed or formed anode shape which has not been sintered. This is shown in FIGS. 5 and 6.

In another method, FIG. 7: the nickel foam buffer 26 is pressed into a sintered anode and the pin 14 then pressed into the nickel foam with an interference fit, step 50, at ambient temperatures and subsequently sealed in Step 34. Radial and longitudinal compression of the foam, because of the interference fit, densifies the foam improving conductivity. When the assembly is elevated to the 1000° C. process temperature, differential expansion further compresses the foam and improves the conductivity; without cracking the cermet. Foams of different relative densities may be used on the bottom and sides to accommodate different compressions resulting from achievable longitudinal and radial fits.

EXAMPLE

An electrode assembly using a hollow inert anode 30 cm long, a metal conductor and compliant, reticulated nickel foam was experimentally produced and tested as follows: a Ni foam insert was seated into the base of the anode and a nickel conductor pin pressed into the bore of the foam. This assembly method produced an interference fit between the pin, the foam, and the bore of the anode, creating an electrical connection. After pinning, the remaining upper annular void between the pin and the open bore of the anode was filled with a castable refractory material. When hardened, this castable became a mechanical joint that stabilized and sealed the pin connection within the anode, and supported all mechanical loads. To test the performance of the nickel foam pinned connection, an experimental aluminum electrolysis run was performed. The "cell" for this run was a midsize furnace constructed of steel and lined with a thermo castable refractory. 240-volt resistance heating elements provided the external heat source. Multiple insulations protected the inside working area of cell, the heating elements, and assisted in heat balance control.

To begin the process, 15 lbs. of high purity aluminum were charged to the inside of the cell. 79 lbs. of cryolite bath were then added on top of the aluminum to provide the eventual conductive path for electrolysis. The assembled anode was next mounted in a moveable fixture and lowered down inside the cell, above the other materials. Insulation was finalized; AC power applied to the cell; and simultaneous preheating of the anode and melting of the cryolite and aluminum initiated. The materials and anode were ramped up to temperature over a 72 hour period. At a molten cryolite temperature of 980° C., a 2 hour hold was performed to insure that bath and metal were melted completely. The anode was then lowered and wetted into the cryolite, as DC power was applied through the anode and molten liquids to the bottom/cathode of the cell; initiating electrolysis. The anode was then further immersed to a depth of 10 cm. into the molten cryolite. The cell was operated and maintained at a constant current of 90 amps and conditions were monitored every hour. The anode supported aluminum production successfully with no cracking.

It should be understood that the present invention may be embodied in other forms without departing from the spirit or essential attributes thereof, and accordingly, reference should be made to both the appended claims and to the foregoing specification as indicating the scope of the invention.

What is claimed is:

1. A method of producing an electrode assembly comprising:

(1) providing an inert electrode having a hollow interior with a top portion and interior bottom and side walls;

(2) inserting a metal pin conductor having bottom and side surfaces and a metal foam into the hollow interior of the electrode; and (3) sealing the top portion of the electrode.

2. The method of claim 1 where the metal foam has a reticulated, open cell network structure of metal particles, is sintered together and is compliant, with a melting temperature over 1000° C.

3. The method of claim 1, wherein the inert electrode is a green inert anode material selected from the group consisting of ceramic and cermet and the pin conductor, and metal foam are inserted into the hollow interior of the anode and then the assembly is heated after step (3) causing the cermet to shrink, compress the metal foam and secure the pin conductor.

4. The method of claim 3, wherein the inert electrode is a green inert anode material selected from the group consisting of ceramic, cermet, metal, and mixtures thereof, and the metal foam is inserted into the hollow interior of the anode and the anode and nickel foam are heated after step (3) causing the cermet to shrink and compress the metal foam, and then, after cooling the pin conductor is inserted into the metal foam by threading or welding.

5. The method of claim 3, wherein the inert electrode is a sintered inert anode material selected from the group consisting of ceramic and cermet and the pin conductor, and metal foam are inserted into the hollow interior of the anode under a further interference fit causing radial and longitudinal compression of the metal foam, densifying the foam.

6. The method of claim 3, wherein the metal foam is selected from the group consisting of nickel foam and nickel alloy foam and has a density of from 5% to 40% of the solid parent metal.

* * * * *